US005361446A

United States Patent [19]

Rufo

[11] Patent Number: 5,361,446

[45] Date of Patent: Nov. 8, 1994

[54] TOOTHBRUSH

[76] Inventor: Mark Rufo, 21 Woodcrest Dr., Concord, N.H. 03301

[21] Appl. No.: 58,558

[22] Filed: May 6, 1993

[51] Int. Cl.[5] ..... A46B 9/04

[52] U.S. Cl. ..... 15/167.1; 15/176.6; 206/362.2; 403/328

[58] Field of Search ..... 15/167.1, 176.1, 176.6; 206/361, 362.2; 403/321, 328

[56] References Cited

U.S. PATENT DOCUMENTS

| | | | |
|---|---|---|---|
| 389,335 | 9/1888 | Spear | 403/328 |
| 1,014,784 | 1/1912 | Tate | 15/176.1 |
| 1,131,863 | 3/1915 | Phillips | 15/176.6 |
| 1,179,800 | 4/1916 | Carswell | 206/362.2 |
| 1,602,531 | 10/1926 | Itoh | 15/167.1 |
| 2,317,002 | 4/1943 | Ulvick | 15/176.6 |
| 2,582,992 | 1/1952 | Hergert | 206/361 |
| 2,598,275 | 5/1952 | Lakin | 15/167.1 |
| 2,736,048 | 2/1956 | Gregoire | 403/328 |
| 3,182,345 | 5/1965 | Smith | 15/176.6 |
| 3,256,031 | 6/1966 | Fillweber | 403/326 |
| 3,851,984 | 12/1974 | Crippa | 15/176.6 |
| 3,927,435 | 12/1975 | Moret | 15/176.1 |
| 4,274,173 | 6/1981 | Cohen | 15/167.1 |
| 4,370,773 | 2/1983 | Hadary | 403/328 |
| 4,880,111 | 11/1989 | Bagwell | 206/362.2 |
| 5,033,154 | 7/1991 | Marchand | 15/167.1 |
| 5,184,368 | 2/1993 | Holland | 15/167.1 |

FOREIGN PATENT DOCUMENTS

| | | | |
|---|---|---|---|
| 21338 | 2/1935 | Australia | 403/328 |
| 75503 | 5/1961 | France | 403/328 |
| 2830945 | 1/1980 | Germany | 403/328 |
| 312971 | 12/1933 | Italy | 15/176.1 |
| 19971 | of 1904 | United Kingdom | 403/328 |
| 766486 | 1/1957 | United Kingdom | 403/328 |
| 2081570 | 2/1982 | United Kingdom | 15/176.6 |

*Primary Examiner*—Timothy F. Simone
*Assistant Examiner*—Randall E. Chin
*Attorney, Agent, or Firm*—William B. Ritchie

[57] ABSTRACT

A novel toothbrush with a permanent handle. The apparatus provides for a permanent handle with a disposable toothbrush head. This permits use of an ornamental or exotic toothbrush handle, while avoiding the problem of the bristles in the brush head wearing out. The handle of the toothbrush secures the bristle head section with the use of a spring loaded plunger located in the handle. The spring mechanism is fully extended while the disposable brush is absent from the handle. When the disposable brush is introduced to the handle, the end of the brush will push against the plunger forcing the spring to retract. When the indent on the end of the brush is directly over the plunger the spring will extend the plunger into the indent and secure the brush within the handle. When it is time for the bristle head section to be replaced, the bristle head section is pulled from the permanent handle and the force of the non indented portion of the brush handle against the plunger, forces the spring mechanism to retract, thus allowing removal of the brush.

6 Claims, 3 Drawing Sheets

TOOTHBRUSH

BACKGROUND OF THE INVENTION

1. Field of the Invention

The invention relates to an improved toothbrush with a non-disposable handle.

2. Description of the Related Art

The toothbrushes currently sold on the market are constructed of inexpensive materials designed such that the entire toothbrush is disposable. Toothbrushes are typically not designed for long term use. Rather, they are designed such that once the bristles have worn down or are otherwise no longer useful, the entire toothbrush is thrown away. The necessity of frequent replacement of the toothbrush prevents use of a decorative or extravagantly designed toothbrush that would be appropriate for gift giving, or long term use. The cost of producing such items for short term use would not be cost effective, or reasonable.

Prior art has shown toothbrushes with a detachable bristle portion such that when the bristles are worn out, the worn out portion can be thrown away while retaining the handle portion. However, the mechanics involved in the prior art have been shown to be awkward. Often they involved some method of screwing in the head, or snap attachments which are likely to wear out. U.S. Pat. No. 4,683,604 shows a toothbrush head which snaps onto a protrusion on the end of the handle portion. This toothbrush has flanks which snap onto the protrusion on the handle section. The major problem is that the protrusion in the handle section may wear down and result in the fit between the two sections not being as secure, and therefore reducing the utility of the toothbrush. Another form of replaceable bristles is found in U.S. Pat. No. 5,005,246. In this case, only the bristles are replaced. The bristle holder is snapped through the back of the head section of the handle and then secured by placement of a cover over the back section. The bristles protrude from the front. With this arrangement there is concern that the bristles will not be as secure as pressure is placed directly on the removable portion of the toothbrush. Thus, there is nothing in the prior art which provides for a partially disposable toothbrush which remains secure with pressure on the bristle portion and resists wear of the connecting sections.

SUMMARY OF THE INVENTION

It is an object of the invention to provide a toothbrush with a non-disposable handle which is cost effective to use.

It is another object of the invention to provide a toothbrush with a non-disposable handle and a replaceable brush head.

It is still another object of the invention to provide a toothbrush with a disposable brush head that is easily and efficiently replaced.

It is still another object of the invention to provide a disposable brush head that can be replaced sanitarily.

The invention is a toothbrush with a disposable brush and a permanent handle which comprises a means for attachment located on said disposable brush and a means for securing said disposable brush to said permanent handle with means located on the brush head, such that said securing means fit within said attachment means when said disposable brush and said permanent handle are joined and said securing means are retracted from said attachment means when said disposable brush is removed from said permanent handle.

DETAILED DESCRIPTION OF THE INVENTION

Figure 1:
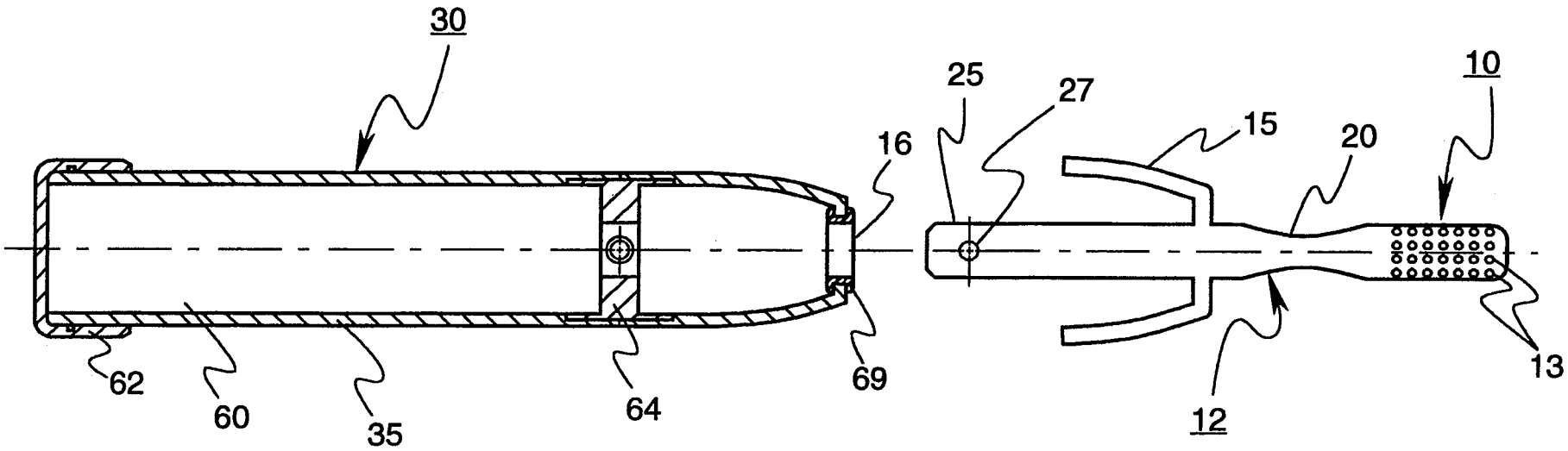
FIG. 1 is a cross-sectional back view of the permanent handle with disposable head.

FIG. 1 is a cross-sectional back view of the permanent handle with disposable head. The disposable brush 12 consists of brush head 10 which houses the bristles 13, the guard 15 medially disposed on the brush along its length which acts as a protective covering over the opening 16 of the permanent handle 30, the neck 20 which attaches the brush head 10 to the guard 15, and the detent 25 which inserts into the permanent handle 30. Guard 15 consists of a hard, impermeable disc having a rim on its underside. The interior diameter of the guard 15 matches the exterior diameter of the top of the permanent handle 30. The rim of the guard 15 snaps over the top of the permanent handle and fits snugly to form a water-impermeable seal. The guard 15 provides minimal surface area for prevention of bacterial or fungal growth. The neck 20 attaches the brush head 10 to the guard 15. Neck 20 is preferably constructed of an inflexible material. The detent 25 is secured to the center of the guard 15. Detent 25 is a solid, inflexible, or slightly flexible piece. One end of detent 25 is permanently attached to the center of the underside of the guard 15. The detent 25 has a small circular indent 27 on an insertion end opposite the attachment to the guard 15.

The permanent handle 30 consists of the shaft 35, which is a flattened tube or elongated rectangular tube, preferably bent for angled insertion into the mouth. At the open end of the shaft is a water-impermeable seal 69, preferably an O-ring, sized with an opening 16 just large enough to accommodate the detent 25. In this embodiment, the shaft 35 is solid with a cavity 60 lengthwise through the midsection of the shaft 35. A bulkhead 64 is located within the shaft 35 at a position an equal distance from the seal 69 as the indent 27 is from the guard 15. The section of the shaft 35 opposite the end with opening 16 may provide for a removable section 62. This removable section 62 will snap onto the shaft 35 and provide for the option of thoroughly cleaning the cavity 60 of the shaft 35.

Figure 2:
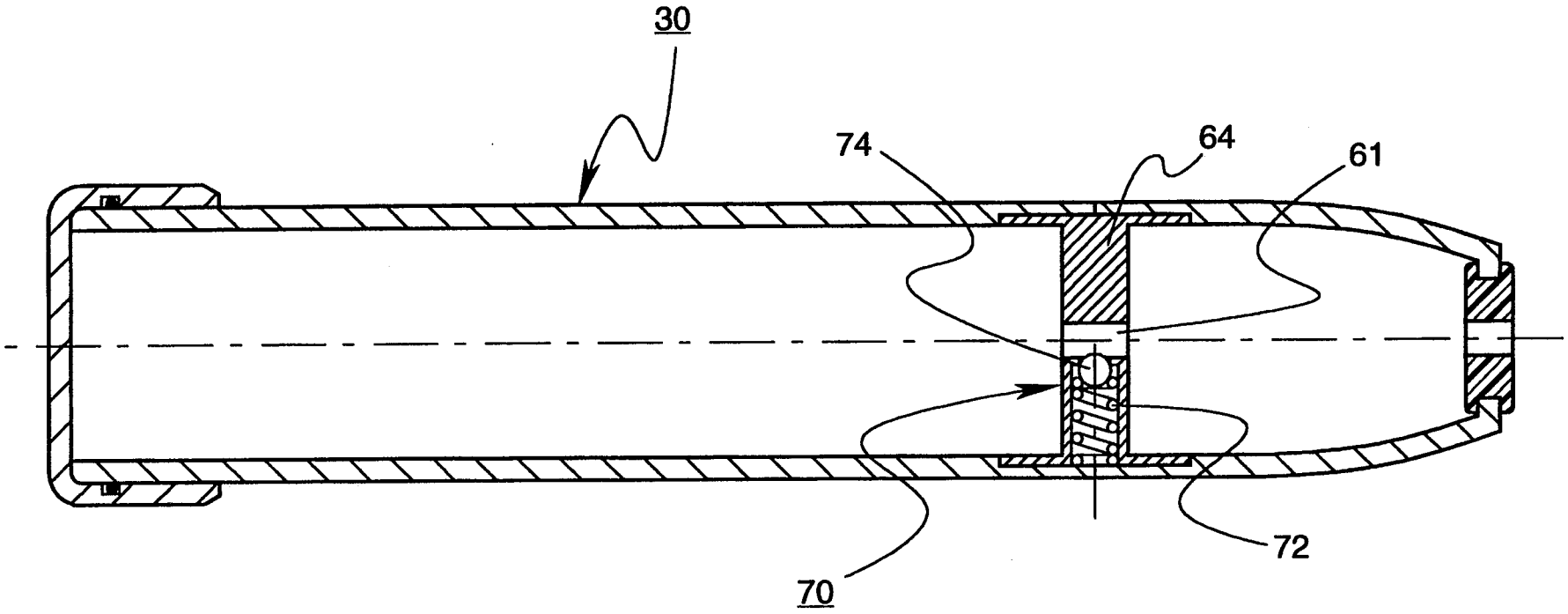
FIG. 2 is a cross-sectional side view of the of the permanent handle.

FIG. 2 is a cross-sectional side view of the of the permanent handle 30. The bulkhead 64 also includes cavity 61 through the center of the bulkhead 64. Located on the bulkhead 64 is a spring loaded plunger 70. Attached to a spring 72 is a plunger 74 having a circular end sized to fit within the interior of the indent 27 in the detent 25. When the disposable brush 12 is removed from the permanent handle 30, the spring 72 is fully extended. However, as the disposable brush enters the bulkhead area, the detent 25 will push against the plunger 74 of the spring loaded plunger 70 forcing the spring 72 to retract into the bulkhead 64. Once the solid portion of the detent 25 passes the plunger 74 and the indent 27 is placed directly over the plunger 74, the plunger 74 will slide into the indent 27, with the expansion of the spring 72. When the plunger 74 is fitted securely within the indent 27, the disposable brush 12 will be secured. To remove the disposable brush 12, the brush is manually pulled from the permanent handle 30. The pressure of pulling the brush pulls against the plunger 74 forcing the spring 72 to retract and allows the brush to be removed from the permanent handle.

Figure 3:
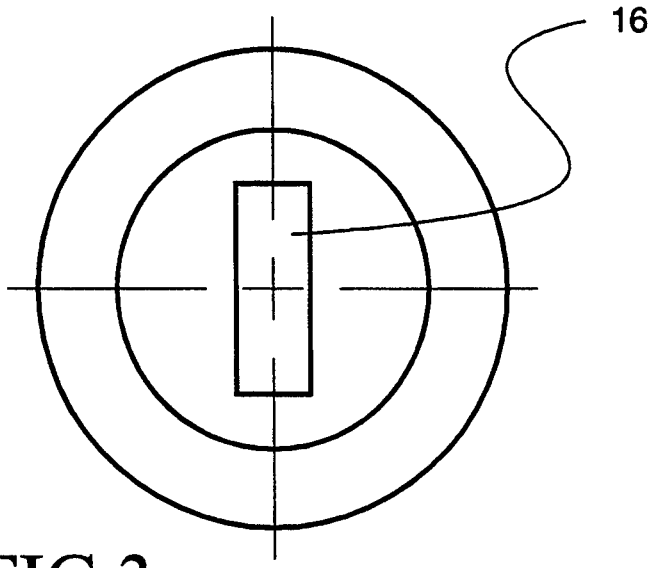
FIG. 3 is top view of the permanent handle.

FIG. 3 shows the top of the opening 16 of the permanent handle 30. The opening 16 is just large enough to accommodate the detent 25. It is important that this opening 16 not be significantly larger than the detent 25 so that the detent 25 is prevented from movement while secured within the permanent handle 30. This helps to solidly secure the disposable brush 12 to the permanent handle 30. The pressure that is exerted against the brush head 10 will not act to disengage the disposable brush 12 from the permanent handle 30. The vertical pull of the disposable brush 12 against the permanent handle 30 is not a normal force exerted on the toothbrush while in use. Thus, the two sections of the toothbrush are secured while in use, yet the disposable brush 12 can easily be removed for replacement.

As the permanent handle 30 is non-disposable, it should be constructed of a durable material. The permanent handle 30 may be made out of exotic substances such as semi-precious and precious metals, tropical hardwoods, stone, or ceramic. It may also incorporate jewel-work. Permanent handles 30 may be sized and styled appropriately for men, women and children.

Figure 4:
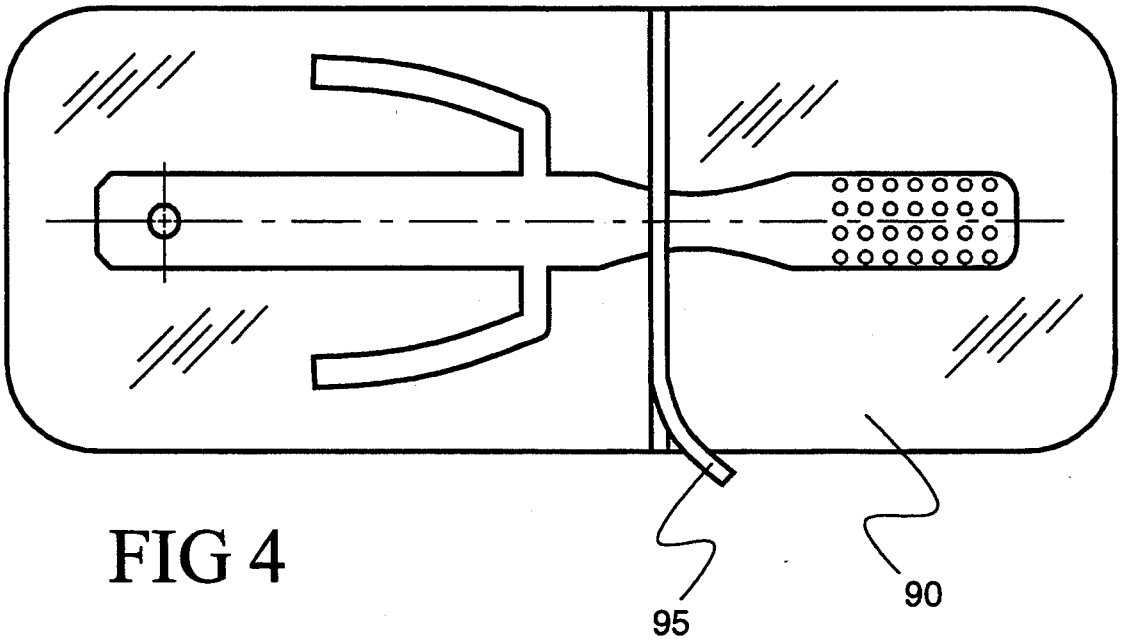
FIG. 4 is a cross-sectional view of the covering surrounding the disposable brush.

FIG. 4 is a cross-sectional view of the covering surrounding the disposable brush 12. The disposable brush 12 is preferably wrapped in a soft, non-permeable covering 90, such as clear plastic. Covering 90 has a tear-away strip 95. Prior to insertion of the disposable brush 12 into the permanent handle 30, the tear-away strip 95 is pulled from the covering 90. This separates the upper and lower half of the covering. Once the tear-away strip 95 is removed, the covering over the detent 25 of the head is removed. The detent 25 is then inserted into the permanent handle 30 and the remaining covering is discarded. The covering 90 allows the user to insert the disposable head into the permanent handle without directly handling the disposable head. This helps to enhance the sanitary nature of the disposable toothbrush.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A toothbrush with a disposable brush and a permanent handle having a cavity, said handle having a bullet-shaped end with an opening therein for receiving said disposable brush comprising:

detent means, including an insertion end and attached to said disposable brush, for releasably engaging said disposable brush to said permanent handle;

plunger means, attached to said permanent handle, for releasably securing said disposable brush to said permanent handle;

a cup-shaped guard, medially disposed on and along the length of said disposable brush, dimensioned to match and snap over the bullet-shaped end of said permanent handle such that when said guard is snapped over the bullet-shaped end of said handle, said guard forms a seal between said guard and said permanent handle;

a water-impermeable seal within the opening of said permanent handle, wherein the opening of said permanent handle and its said seal are dimensioned to correspond to the insertion end of said detent means such that when the insertion end of said detent means is inserted into the opening of said permanent handle, said seal forms a water-impermeable connection between said detent means of said disposable brush, adjacent to said guard, and said permanent handle.

2. The toothbrush of claim 1, wherein said plunger means is a spring loaded plunger and wherein said detent means further comprises a circular indentation, said plunger having a circular end, dimensioned to fit within the circular indentation of said detent means.

3. The toothbrush of claim 2, wherein said plunger means is retracted by extension of a spring, and said plunger is inserted into said detent when said spring is extended.

4. The toothbrush of claim 3, wherein water-impermeable seal is an O-ring.

5. The toothbrush of claim 4 wherein said permanent handle further comprises a removable section dimensioned to snap over said handle such that said removable section can be removed to permit cleaning of the cavity of said permanent handle.

6. The toothbrush of claim 5 wherein said disposable brush is wrapped in a water-impermeable covering having a tear strip centrally located within said covering such that when said tear strip is pulled, said covering easily separates from said disposable brush.

* * * * *